US009572477B2

(12) United States Patent
Burhans

(10) Patent No.: US 9,572,477 B2
(45) **Date of Patent: *Feb. 21, 2017**

(54) HANDHELD DISHWASHING DEVICE

(71) Applicant: David Burhans, Jupiter, FL (US)

(72) Inventor: David Burhans, Jupiter, FL (US)

( * ) Notice: Subject to any disclaimer, the term of this patent is extended or adjusted under 35 U.S.C. 154(b) by 439 days.

This patent is subject to a terminal disclaimer.

(21) Appl. No.: 13/779,157

(22) Filed: Feb. 27, 2013

(65) Prior Publication Data

US 2013/0167312 A1 Jul. 4, 2013

Related U.S. Application Data

(62) Division of application No. 12/924,512, filed on Sep. 29, 2010, now Pat. No. 8,403,578.

(51) Int. Cl.
*A47L 17/00* (2006.01)
*A47L 15/00* (2006.01)

(52) U.S. Cl.
CPC ..... *A47L 17/00* (2013.01); *A47L 15/0089* (2013.01)

(58) Field of Classification Search
CPC ..... A47L 17/00; A47L 17/04; A47L 17/06; A47L 17/08; A47L 13/12; A47L 15/0089; A46B 5/002; A46B 5/0054; A46B 5/0058; A46B 5/0075; A46B 5/0083; A46B 5/0087
USPC ..... 15/105, 111, 172; 401/16, 23, 24, 27, 401/34–36, 39–43
See application file for complete search history.

(56) References Cited

U.S. PATENT DOCUMENTS 1,509,381 A * 9/1924 Townsend ..... A47L 17/04 15/210.1
2,032,664 A * 3/1936 Raptis ..... A46B 5/0075 15/144.1
2,879,532 A * 3/1959 Gyozo Szabo ..... A47L 13/22 401/24
3,199,139 A * 8/1965 Vallis ..... A47L 17/00 15/111
3,989,391 A * 11/1976 Thorner ..... 401/43
6,155,620 A * 12/2000 Armstrong ..... 15/105
6,438,784 B1 * 8/2002 Yu ..... 15/106

* cited by examiner

*Primary Examiner* — Jennifer C Chiang
*Assistant Examiner* — Bradley Oliver
(74) *Attorney, Agent, or Firm* — Robert M. Downey, P.A.

(57) ABSTRACT

A handheld dishwashing device for cleaning dishes and utensils includes a handle, a clean water tube for receiving and transferring a pressurized flow of heated water, a soap tube for receiving and transferring a flow of soap, a first and second clean water discharge port in fluid flow communication with the clean water tube, a trigger for selectively operating the flow of water to the first and second clean water discharge ports, at least one cleaning head component, a soap discharge port in communication with the soap tube for emitting the soap onto the cleaning head component, a cleaning head extension bar, and a rinse extension bar being structured and disposed for pivotal movement relative to the handle for holding the cleaning head component, thereby allowing for selective use of one of either the top or bottom sides of the cleaning head component.

10 Claims, 5 Drawing Sheets

HANDHELD DISHWASHING DEVICE

BACKGROUND OF THE INVENTION

Field of the Invention

The present invention relates to a handheld dishwashing device and, more particularly, to a handheld dishwashing device that allows for easy, one-handed operation of the handheld dishwashing device, and requires a minimal amount of water, which can be accessed from direct hook up to plumbing or from a contained water supply.

Discussion of the Related Art

Over the years, automatic dishwashers have become commonplace in households in the United States, and provide a convenient method of cleaning and sterilizing dishes and eating utensils. Typically, dirty dishes are loaded into the dishwasher, which, in operation, sprays heated water at 130-150 degrees Fahrenheit onto the dishes. A detergent and water mixture is then used to clean the dishes, followed by clean water to remove the detergent residue. While such represents the typical dishwashing cycle process in both residential and commercial dishwashers alike, a number of advances have been made in recent years in an effort to further enhance the cleansing capabilities of dishwashers, such as the use of multiple wash and rinse cycle periods as well as the inclusion of rinsing aids.

A considerable drawback of traditional automatic dishwashers is the large amount of water required during each wash and rinse cycle. Such a negative characteristic becomes readily apparent when an automatic dishwasher is used when it is not filled to full capacity, which is likely to occur in households of one to three persons. Furthermore, a number of situations may present themselves to an individual who may have dirty dishes but is in a location lacking an automatic dishwasher. For example, a college dorm room rarely comes equipped with an automatic dishwasher, however, college students often utilize micro-refrigerators that include an attached microwave, which is used to heat entire meals. Consequently, college students must either purchase disposable paper plates and plastic eating utensils or engage in the cumbersome task of hand washing the dirty dishes.

Only a few dishwashing devices have been developed that can be used in a portable fashion. A number of these portable dishwashing devices are non-electric, and are powered by water pressure alone. For example, U.S. Pat. No. 4,542,756 discloses a portable non-electric dishwasher system that is especially suited for insertion within a sink and includes an enclosed dish-holding container, and is entirely reliant on the water pressure supplied by an outside source. Suspended throughout the interior of the enclosure is a series of expansible water bladders having multiple apertures for spraying water on the dirty dishes. With the application of the pressurized water, the bladders expand, which effectively scrubs the dirty dishes. The continued expansion of the bladders eventually triggers an outflush of water from the apertures, thus rinsing the dirty dishes. This scrub and rinse cycle continues over a period of time as determined by the user.

U.S. Pat. No. 5,518,014 discloses a portable countertop dishwasher that is electrically powered and structured for placement alongside a sink. The portable countertop dishwasher includes a housing cavity with a fluid handling assembly contained therein and having an upper pump and a lower pump, each within its own housing. In operation, the pumps distribute fluid amongst the dishes within the housing cavity, with an outlet conduit serving to release the fluid from the housing.

While the portable dishwashing devices described above are useful for their intended purpose, there remains a need for a more practical and efficient portable dishwashing device that is easily transportable and allows for quick and easy cleansing of dirty dishes. The present invention seeks to address the limitations and shortcomings of presently known portable dishwashing devices, as well as to effectively minimize the amount of water that is wasted during the cleansing process.

OBJECTS AND ADVANTAGES OF THE INVENTION

Considering the foregoing, it is a primary object of the present invention to provide a handheld dishwashing device that allows for easy, one handed operation in order to wash dishes, glasses cups, eating utensils, pots, pans and the like, on an as needed basis.

It is a further object of the present invention to provide a handheld dishwashing device that allows for fast and easy dishwashing, and that is ready to use, on demand.

It is still a further object of the present invention to provide a handheld dishwashing device which is adapted to clean one dish in a matter of seconds with no wasted water and considerably less energy uses as compared to other conventional dishwashing systems and dishwashing methods.

It is yet a further object of the present invention to provide a handheld dishwashing device that is adapted to soap and rinse at the same time, thereby saving time, energy and water.

It is still a further object of the present invention to provide a handheld dishwashing device that is structured to direct hot water directly into a cleaning head while helping to keep food and germs out of the cleaning head.

It is still a further object of the present invention to provide a handheld dishwashing device that provides a pivotable and rotatable cleaning head that receives a flow of hot water and soap mixture, and wherein the cleaning head surface remains hot even when turned upside down.

It is still a further object of the present invention to provide a handheld dishwashing device that provides a rinse extension arm that is structured and disposed for holding the cleaning head in position.

It is yet a further object of the present invention to provide a handheld dishwashing device as set forth above, and wherein the cleaning head is structured and disposed for wiping, scraping and scrubbing dishes, pots, pans and the like.

These and other objects and advantages of the present invention are more readily apparent with reference to the detailed description and accompanying drawings.

SUMMARY OF THE INVENTION

The present invention is directed to a handheld dishwashing device that is easily transportable and allows for quick and easy cleansing of dishes. The handheld dishwashing device includes a cleaning head component having top and bottom cleaning sides for brushing, scraping, and wiping dish surfaces, and for further applying heated water and soap mixture in order to wash dishes and utensils. A rinse extension bar is pivotally connected to the handle of the device and is provided for engaging the cleaning head component for holding the cleaning head component and preventing rotational or pivotal movement of the cleaning head component, thereby allowing for selective use of one of either the top or bottom sides of the cleaning head component. The handheld dishwashing device also provides a clean and rinse function to rinse the soapy water from the cleaned dishes and utensils. The handheld dishwashing device is adapted for connection to a conventional plumbing system or other water flow supply source via attachment or, alternatively, supplied from a portable water holding tank in connection with a base unit.

BRIEF DESCRIPTION OF THE DRAWINGS

For a fuller understanding of the nature of the present invention, reference should be made to the following detailed description taken in conjunction with the accompanying drawings in which.

Like reference numerals refer to like referenced parts throughout the several views of the drawings.

DETAILED DESCRIPTION OF THE PREFERRED EMBODIMENTS

Referring to the several views of the drawings, the handheld dishwashing device that is easily transportable, requires a minimal amount of water, and allows for quick and easy cleansing of dishes is shown according to the several embodiments of the invention and is generally indicated as 10.

Figure 1:
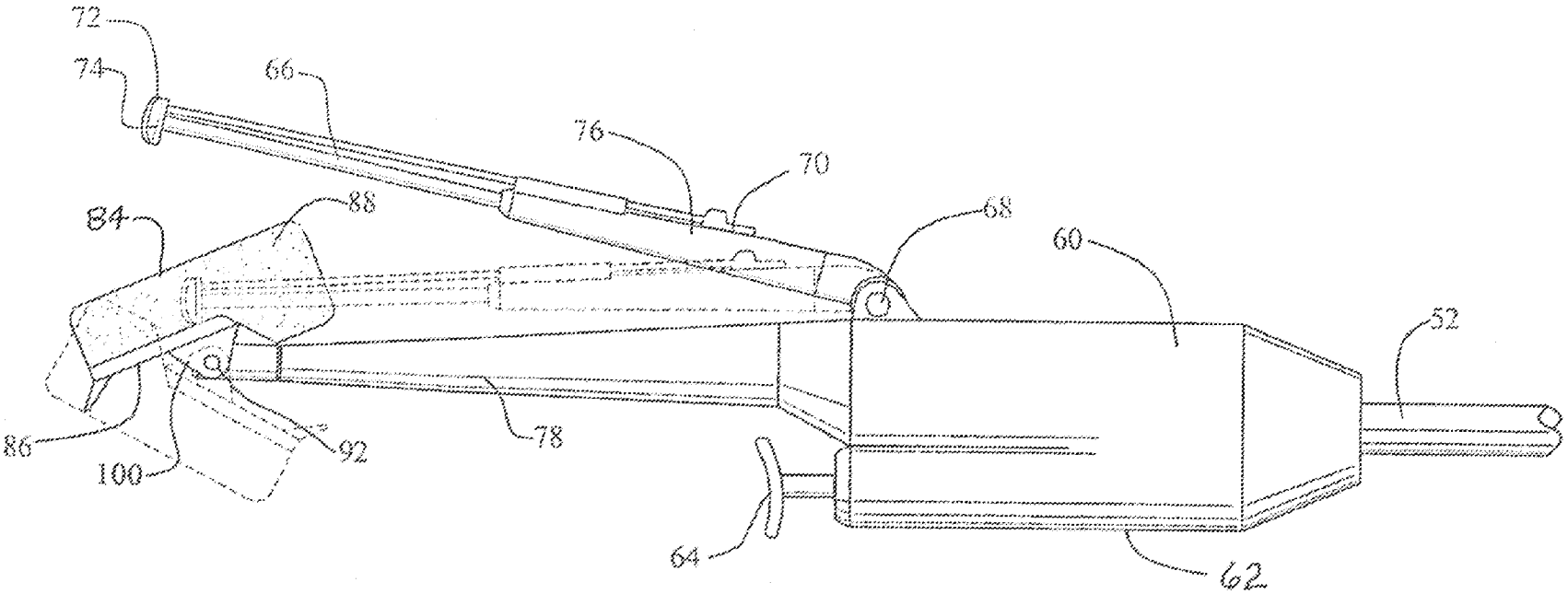
FIG. 1 is a side view of the handheld dishwashing device of the present invention illustrating a rinse extension bar, a scraper, a rinse tube water exit, a thumb grip, a swivel pin for allowing pivoting of the rinse extension bar, a cleaning head extension, a cleaning head base with a filter or sponge material optionally enclosed by fabric, a trigger for operation of the handheld dishwashing device, and a tube encasing the soap line and the hot water line.
Figure 2:
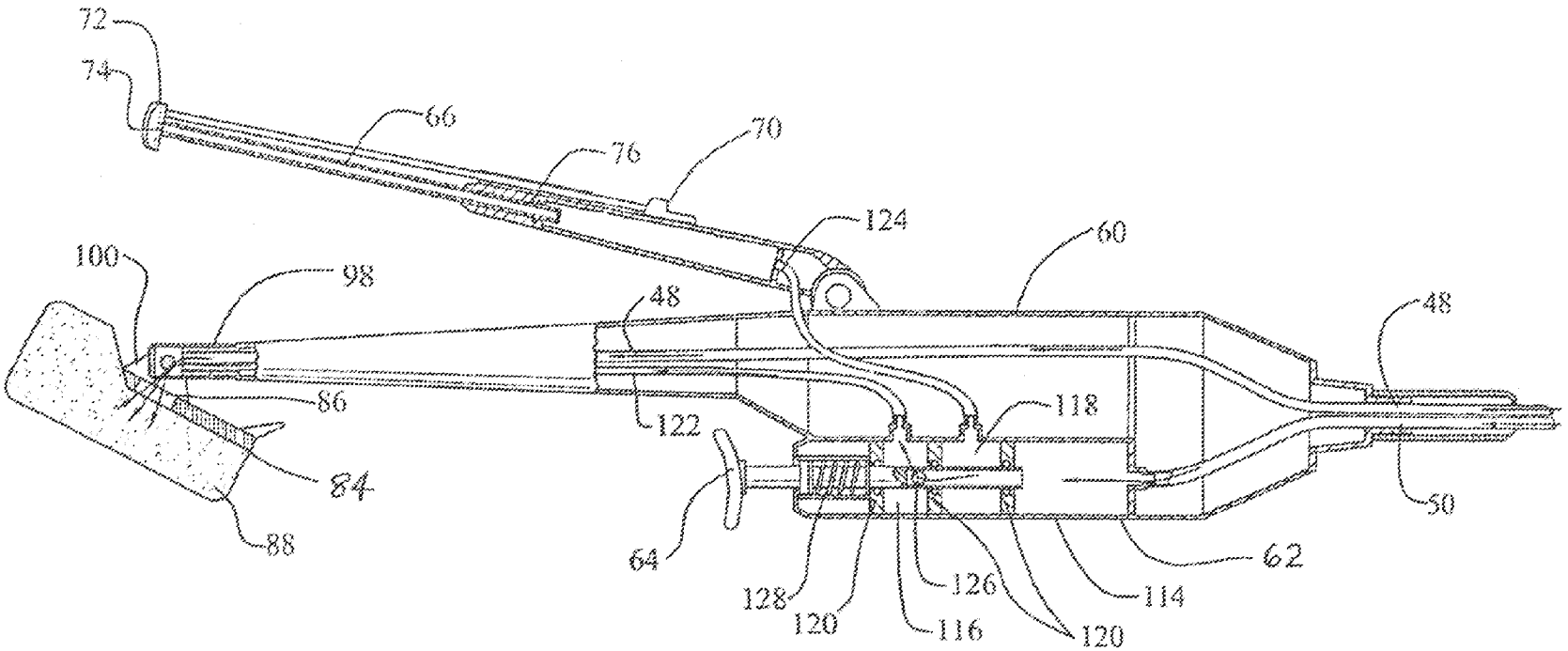
FIG. 2 is a side view, shown in partial cross section, illustrating the handheld dishwashing device of the present invention in a static configuration, and showing a soap line extending directly through the cleaning head extension bar, a first hot water line, and a second hot water line, and a trigger for controlling the flow of water to the cleaning head and rinse extension bar.
Figure 3:
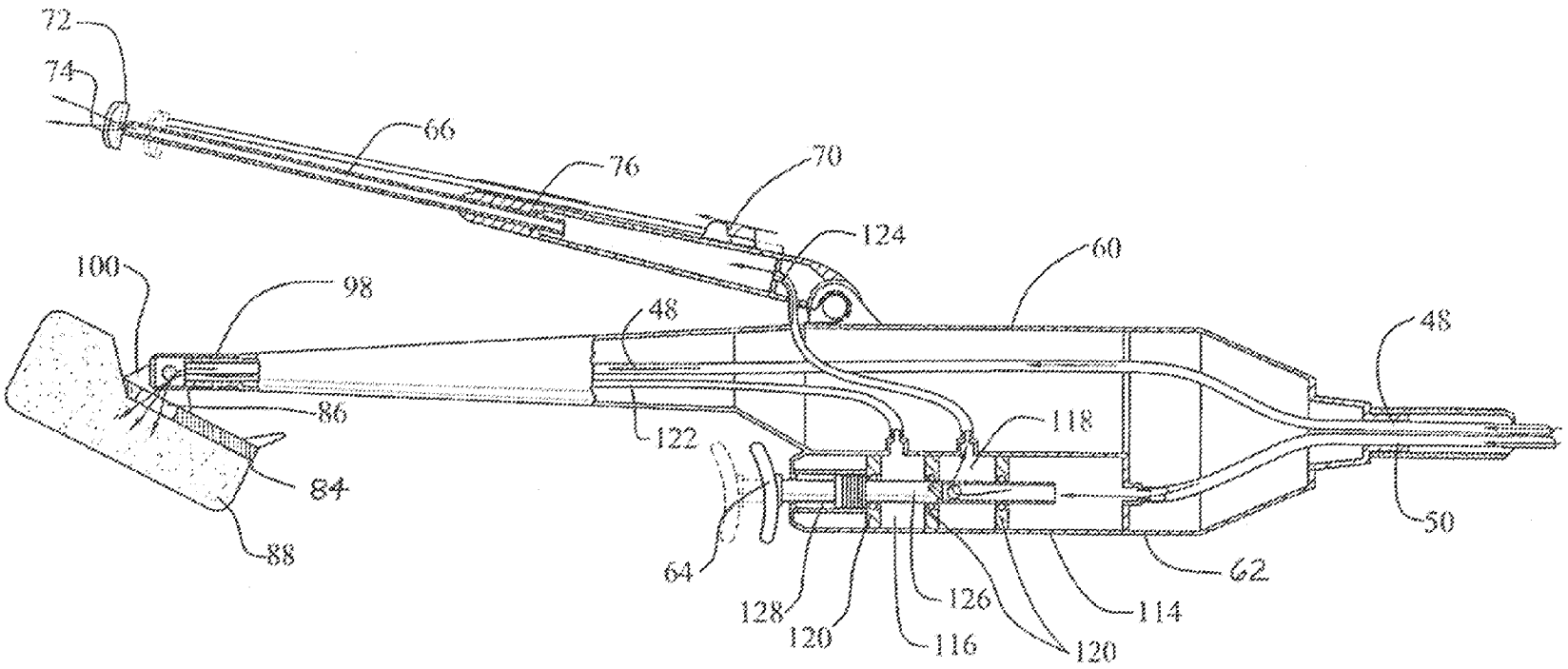
FIG. 3 is a side view, shown in partial cross section, illustrating the handheld dishwashing device of FIG. 1, and showing movement of the rinse extension bar and operational movement of the trigger.

Referring initially to FIGS. 1-3, the handheld dishwashing device 10 is ergonomically structured for being grasped within a user's hand in a position that allows the user's forefinger to depress an actuator member, which is defined by the trigger 64. The handheld dishwashing device 10 includes a rinse extension bar chamber 76 that slideably captivates a rinse extension bar 66 that extends outwardly from the distal end of the rinse extension bar having chamber 76. A pivot pin 68 connects the rinse extension bar chamber 76 with the handle 62 of the handheld dishwashing device 10 and allows for guided, pivoting movement of the rinse extension bar 66 and chamber 76 about the pin 68 and relative to an elongate member defining the cleaning head extension bar 78 so that the rinse extension bar 66 can be moved towards the cleaning head extension bar 78 to hold the cleaning head 84 while scrubbing and scraping (see broken line illustration in FIG. 1). A spring 77 at the swivel pin 68 urges the rinse extension bar 66 to a relaxed position shown in FIGS. 2 and 3. A thumb grip 70 is ergonomically placed along the rinse extension bar 66 to allow the user to easily extend the rinse extension bar 66 outwardly relative to the chamber 76 by applying pressure to the thumb grip 70. At the distal end of the rinse extension bar 66 is a scraper 72 that can be used to scrape dirty dishes during the cleaning process. A rinse tube water exit 74 is also located at the distal end of the rinse extension bar 66. The rinse extension bar 66 can extend out from and retract within the rinse extension bar chamber 76 to accommodate the user's needs.

Figure 4:
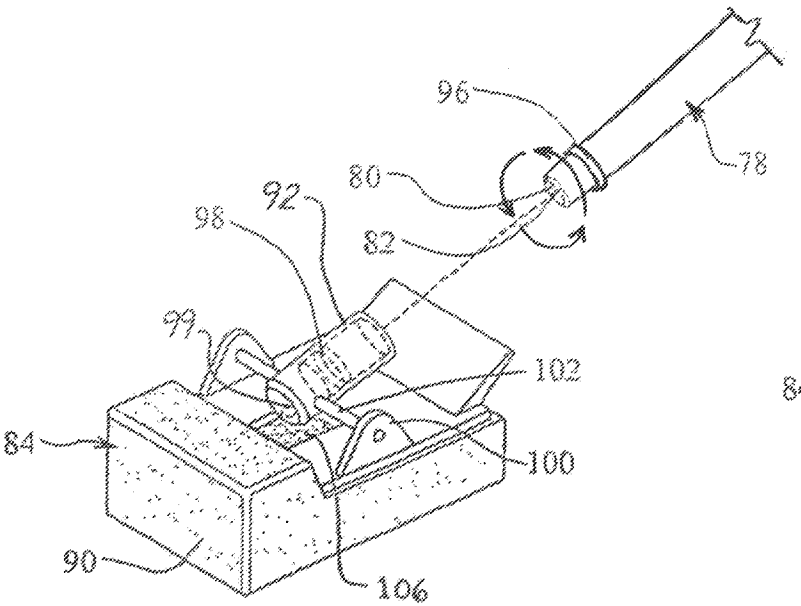
FIG. 4 is an isolated perspective view of the cleaning head, in accordance with a preferred embodiment, showing an cleaning head extension bar with a first reduced hole for the soap mixture to exit the cleaning head and a second reduced hole for the hot water to exit the cleaning head, a male ring for snap-on attached engagement within a female receptacle of the cleaning head, a cleaning head base with associated filter or sponge material covered with an optional fabric, and further illustrating rotational movement of the male fitting on the end of the extension bar relative to the female receptacle, thereby allowing 360 degree rotation of the cleaning head.

Also extending from the handle 62 of the handheld dishwashing device 10 is a cleaning head extension bar 78. Located at the distal end of the cleaning head extension bar 78 is a first reduced hole 80 for the soap mixture 162 to exit and a second reduced hole 82 for the hot water to exit, as shown in FIG. 4. A cleaning head 84 attaches to the distal end of the cleaning head extension bar 78, which includes a cleaning head base 86 and a filter or sponge material 88 suitable for scrubbing dishes. As illustrated, the cleaning head base 86 can freely rotate and has no fixed positions. An optional fabric 90 covers the filter or sponge material 88. Additionally, the cleaning head extension bar 78 and the rinse extension bar 66 can be moved together, as illustrated by the broken lines in FIG. 1, allowing the user to reach narrow areas while cleaning, and the sponge material 88 freely follows the shape of dishes and utensils when being used, thereby enabling a user to clean the dishes and utensils without having to angle the device 10 in awkward positions. The cleaning head 84 pivots into position by itself in response to the pressure applied by the user against the dish or utensil. This pivot action permits the device 10 to alternate between the sponge material 88 and other cleaning surfaces on the cleaning head 84, such as the scraper 103 (see FIGS. 4 and 6) and rubber brush bristles 104 (see FIG. 5), without having to change hand positions and while maintaining the finger on the trigger 64. Multiple embodiments of the cleaning head 84 are contemplated, each of which can be interchangeably attached to the cleaning head extension bar 78, providing the user with a variety of cleaning options.

Figure 5:
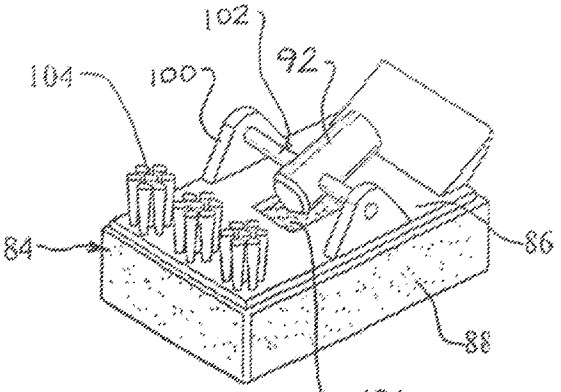
FIG. 5 is an isolated perspective view of the cleaning head, in accordance with another embodiment, showing a female receptacle of the cleaning head, a cleaning head base with associated filter or sponge material, and a grouping of rubber brush bristles.
Figure 6:
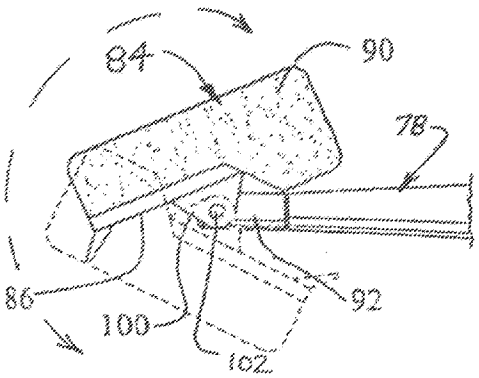
FIG. 6 is an isolated side view illustrating a range of pivoting movement of the cleaning head about a pivot pin relative to the distal end of the extension bar.

Referring to FIGS. 4-6, the structure of the cleaning head 84 and its method of attachment to the cleaning head extension bar 78 is shown in accordance with a preferred embodiment. In the embodiment shown in FIGS. 4-6, the cleaning head extension bar 78 includes a male snap-on attachment component 96, generally in the form of a ring, that engages a female snap-on attachment component 98, generally in the form of an annular groove, within female receptacle 92. The receptacle 92 is rotatably held on a swivel rod component 100, allowing the cleaning head 84 to rotate about the swivel rod axis 102, as indicated by the arrows in FIG. 4. A hole 99 in the female receptacle 98 (see FIG. 4) directs the flow of hot water and soap into the filter material (or spongy material) exposed within square opening 106 of the cleaning head base 86.

Several embodiments of the cleaning head 84 are contemplated within the scope of the invention. The cleaning head 84 illustrated in FIGS. 4 and 6 includes the cleaning head base 86 with an integrally formed scraper 103, the array of rubber brush bristles 104 (see FIG. 5), and the filter or sponge material 88 with the filter or sponge material and bristles covered by the optional fabric 90. The user can use the scraper 103 as a traditional scraper or squeegee for wiping the dish clean of grease and food, and then flip the cleaning head 84 to use the sponge material 88 to finish the cleaning process. Use of the scraper 103 prevents the sponge material 88 from contacting grease and food, thereby limiting the amount of water and soap required for the cleaning process. Another embodiment of the cleaning head 84 is illustrated in FIG. 6 and includes an array of rubber brush bristles 104 attached to the cleaning head base 86, and the filter or sponge material 88, but without the optional fabric.

Figure 7:
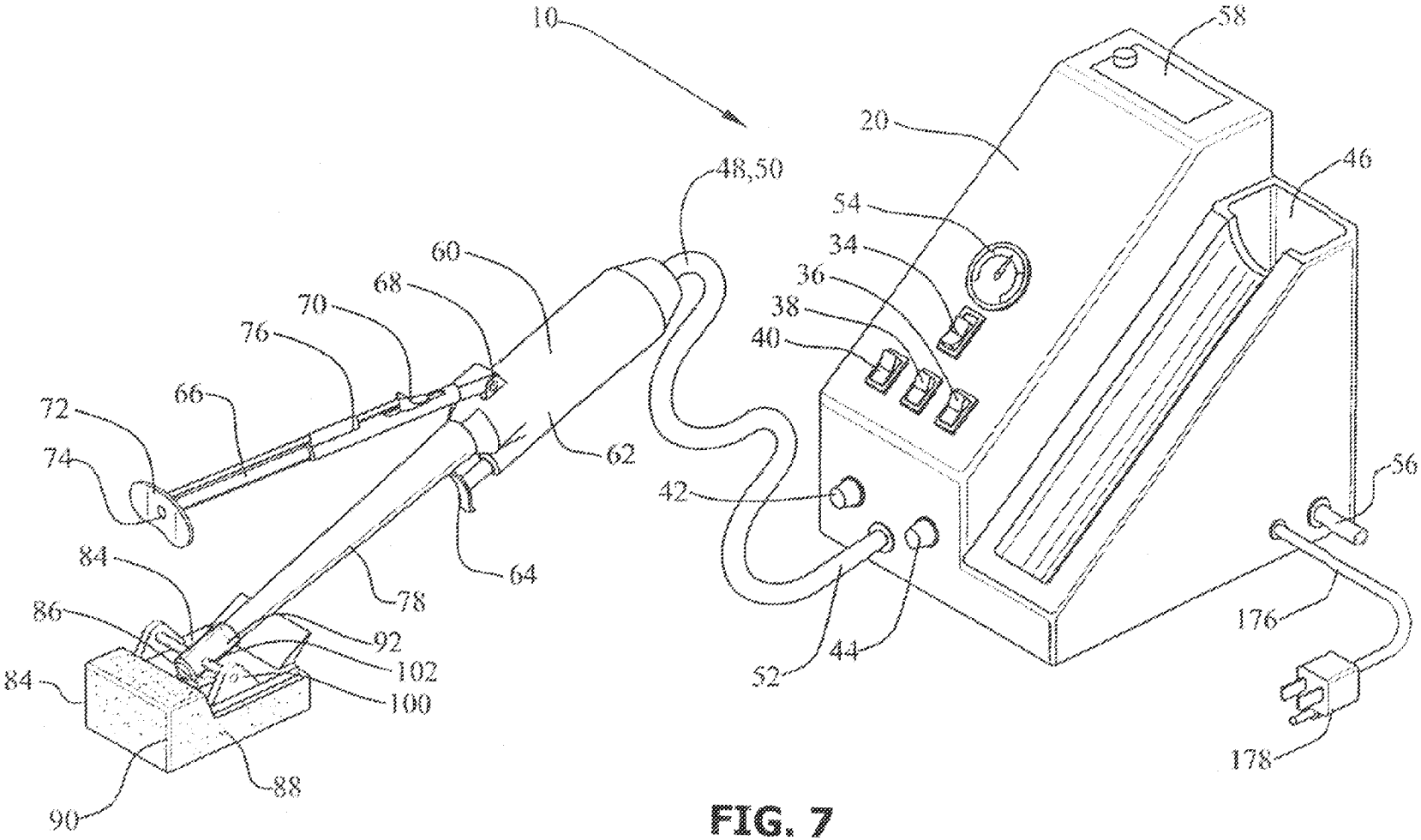
FIG. 7 is a perspective view illustrating the handheld dishwashing device of the present invention used in combination with a base unit.

In operation, a water source and soap or soap mixture source are provided and are in communication with the handheld dishwashing device 10 by hand unit water line 50 and hand unit soap line 48, respectively. As shown in FIG. 7, a hand unit connector tube 52 may encase the hand unit soap line 48 and the hand unit water line 50 for preventing the two lines from tangling. Referring to FIGS. 1-3, the hand unit soap line 48 and the hand unit water line 50 enter the handheld dishwashing device 10, and the hand unit soap line 48 travels through the handle 62 and the cleaning head extension bar 78, ending at the first reduced hole 80 (see FIG. 4), allowing the soap mixture to exit onto the cleaning head 84.

The hand unit water line 50 travels through the handle 62, ending at a hot water chamber 114 encased within the handle 62. The hot water chamber 114 is divided into separate chambers—a cleaning head hot water chamber 116 and a rinse extension hot water chamber 118—by spaced washers 120. A cleaning head hot water line 122 connects the cleaning head hot water chamber 116 with the second reduced hole 82 (see FIG. 4) for the hot water to exit onto the cleaning head 84. A rinse extension hot water line 124 connects the rinse extension hot water chamber 118 with the rinse tube water exit 74, located at the distal end of the rinse extension bar 66.

The trigger 64 controls whether water is taken from the cleaning head hot water chamber 116 or the rinse extension hot water chamber 118. When the trigger 64 is in a relaxed position, as illustrated in FIG. 2, water continuously flows from the cleaning head hot water chamber 116 to the cleaning head hot water line 122 via a hot water exit hole 126, and water is emitted from the reduced hole 82 onto the cleaning head 84. When the trigger 64 is depressed, as illustrated in FIG. 3, the hot water exit hole 126 is displaced, allowing water to continuously flow from the rinse extension hot water chamber 118 to the rinse extension hot water line 124, and water is emitted from the rinse tube water exit 74. When the trigger 64 is released, a spring 128 returns the trigger 64 to its relaxed position, as illustrated in FIG. 2.

Referring to FIG. 7, the handheld dishwashing device 10 is shown in combination with a base unit 20, which is used to heat a pressurized flow of water and to mix and store soap for use by the handheld dishwashing device 10. The base unit includes a heater unit control knob 34, a water holding unit pump knob 36, a heater unit power knob 38, a water toggle switch 40, a pressure reducer control knob 42, and a soap adjustment knob 44. A storage compartment 46 for the accompanying handheld dishwashing device 10 is provided that also serves to catch any water run-off from the handheld dishwashing device 10 after being used. A hand unit drain tube 56 extends outwards from the base unit 20 for draining the excess water run-off within the storage compartment 46. A soap unit compartment 58 located on the base unit 20 can be opened to access a soap mixture tank. Extending from the front side of the base unit 20 are a hand unit soap line 48 and a hand unit water line 50 that connect the base unit 20 with the handheld dishwashing unit 10. Encasing the hand unit soap line 48 and the hand unit water line 50 is a hand unit connector tube 52.

While the present invention has been shown and described in accordance with several practical and preferred embodiments, it is recognized that departures from the instant disclosure are fully contemplated within the spirit and scope of the invention which is limited only by the following claims as interpreted by the Doctrine of Equivalents.

What is claimed is:

1. A handheld dishwashing device for cleaning dishes and utensils, said handheld dishwashing device comprising:

a handle;

an elongate member extending from said handle and having a distal end portion;

a clean water tube being structured and disposed for receiving and transferring a pressurized flow of water;

a soap tube being structured and disposed for receiving a controlled flow of soap mixture from a soap supply source;

at least one clean water discharge port in fluid flow communication with said clean water tube and independent of said soap tube;

an actuator member for selectively operating the pressurized flow of water from said clean water tube to said at least one clean water discharge port for discharge therefrom;

at least one cleaning head component attachable to the distal end portion of the elongate member and being structured and disposed for scrubbing dishes and utensils, and said at least one cleaning head component being rotatable and pivotable relative to said handle and said elongate member, and said at least one head component including a plurality of cleaning tools thereon;

a soap mixture discharge port in communication with said soap tube and independent of said at least one clean water discharge port, and said soap mixture discharge port being structured and disposed for emitting said soap mixture onto said at least one cleaning head component; and a rinse extension bar extending from said handle and having a distal end, and said distal end being extendable and retractable relative to said handle and said at least one cleaning head component, and said rinse extension bar being structured and disposed for movement relative to said handle and said at least one cleaning head component so that said distal end engages said at least one cleaning head component and holds said at least one cleaning head component while preventing pivotal movement of said at least one cleaning head component.

2. The device as recited in claim 1 wherein said at least one cleaning head component includes a sponge material for scrubbing and wiping and defining one of said plurality of cleaning tools.

3. The device as recited in claim 1 wherein said at least one cleaning head component includes a scrubbing tool defining one of said plurality of cleaning tools.

4. The device as recited in claim 1 wherein said at least one cleaning head component includes a scraping element and defining one of said plurality of cleaning tools.

5. A handheld cleaning device comprising:

a handle;

an elongate member extending from said handle and having a distal end portion;

at least one cleaning head component attachable to the distal end portion of the elongate member and being structured and disposed for engagement with a surface being cleaned, and said at least one cleaning head component being pivotable relative to said handle and said elongate member; and a holding bar pivotally attached on an exterior of the device and having a distal end, and said holding bar being spaced exteriorly from said elongate member so that said holding bar is readily accessible for hand controlled operation while grasping the handle and using the device, and said holding bar being structured and disposed for movement relative to said handle and said at least one cleaning head component so that said distal end of said holding bar can be selectively moved into engagement with said at least one cleaning head component for holding said at least one cleaning head component while preventing pivotal movement of said at least one cleaning head component and further so that said distal end of said holding bar can be selectively released from engagement with said at least one cleaning head component, and wherein said holding bar can be selectively moved into and out of engagement with said at least one cleaning head component, without interruption, when using the device.

6. The device as recited in claim 5 wherein said distal end of said holding bar is extendable and retractable relative to said handle.

7. The device as recited in claim 5 wherein said at least one cleaning head component includes a sponge material for scrubbing and wiping the surface being cleaned.

8. The device as recited in claim 5 wherein said at least one cleaning head component includes a scrubbing tool for scrubbing the surface being cleaned.

9. The device as recited in claim 5 wherein said at least one cleaning head component includes a scraping element for scraping the surface being cleaned.

10. A handheld dishwashing device for cleaning dishes and utensils, said handheld dishwashing device comprising:

a handle;

an elongate member extending from said handle and having a distal end portion;

a clean water tube being structured and disposed for receiving and transferring a pressurized flow of water;

a soap tube being structured and disposed for receiving a controlled flow of soap mixture from a soap supply source;

at least one clean water discharge port in fluid flow communication with said clean water tube and independent of said soap tube;

an actuator member for selectively operating the pressurized flow of water from said clean water tube to said at least one clean water discharge port for discharge therefrom;

at least one cleaning head component attachable to the distal end portion of the elongate member and being structured and disposed for scrubbing dishes and utensils, and said at least one cleaning head component being pivotable relative to said handle and said elongate member, and said at least one head component including a plurality of cleaning tools thereon;

a soap mixture discharge port in communication with said soap tube and independent of said at least one clean water discharge port; and a rinse bar extending from said handle and having a distal end, and said rinse bar being structured and disposed for movement relative to said handle and said at least one cleaning head component so that said distal end engages said at least one cleaning head component and holds said at least one cleaning head component while preventing pivotal movement of said at least one cleaning head component.

* * * * *